US006971431B2

(12) United States Patent
Steinberger

(10) Patent No.: US 6,971,431 B2
(45) Date of Patent: Dec. 6, 2005

(54) TAPE DISPENSER

(76) Inventor: Robert Steinberger, 14 Van Winkle Rd., Monsey, NY (US) 10952

( * ) Notice: Subject to any disclaimer, the term of this patent is extended or adjusted under 35 U.S.C. 154(b) by 0 days.

(21) Appl. No.: 10/408,134

(22) Filed: Apr. 7, 2003

(65) Prior Publication Data

US 2004/0194896 A1 Oct. 7, 2004

(51) Int. Cl.[7] ..... B32B 31/00

(52) U.S. Cl. ..... 156/527; 156/576; 156/577; 156/579; 225/56; 225/80

(58) Field of Search ..... 156/577, 579, 156/522, 523, 527, 576; D19/67, 69; 225/23, 225/56, 77, 89, 91, 39, 46, 80, 90

(56) References Cited

U.S. PATENT DOCUMENTS

| | | | | |
|---|---|---|---|---|
| 2,823,968 A | | 2/1958 | Marcuse et al. | |
| 3,156,603 A | * | 11/1964 | Robinson | 156/577 |
| 3,470,781 A | | 10/1969 | Domeny | |
| 3,895,059 A | | 7/1975 | Link | |
| 3,968,001 A | * | 7/1976 | Lockwood | 156/523 |
| 3,971,280 A | | 7/1976 | Inka | |
| 4,345,966 A | * | 8/1982 | Iiyama et al. | 156/523 |
| 4,486,263 A | * | 12/1984 | Monzo Gomez | 156/523 |
| 4,640,167 A | | 2/1987 | Stusack et al. | |
| 4,775,084 A | | 10/1988 | Morikami et al. | |
| 5,257,711 A | | 11/1993 | Wirtz-Odenthal | |
| 5,295,753 A | * | 3/1994 | Godo et al. | 400/612 |
| 6,053,233 A | | 4/2000 | Lin | |
| 6,422,284 B1 | * | 7/2002 | Kelders et al. | 156/540 |
| 6,439,289 B1 | * | 8/2002 | Schlotthauer | 156/539 |
| 6,510,884 B1 | * | 1/2003 | Chan | 156/527 |
| 2002/0069974 A1 | | 6/2002 | Niermann | |

* cited by examiner

*Primary Examiner*—Christopher A. Fiorilla
*Assistant Examiner*—Cheryl N. Hawkins
(74) *Attorney, Agent, or Firm*—Michael E. Zall

(57) ABSTRACT

A tape dispenser for applying adhesive tape to a substrate surface. The dispenser includes an exterior application surface with an opening therein. A plurality of rotatable cylindrical rollers are mounted within the housing, wherein the surfaces of the rollers coact with each other and the tape surfaces to retain, guide and feed the tape through the tape dispensing opening to the exterior application surface. At least two of the plurality of rollers are opposed rollers that engage the tape surfaces therebetween. The outer surface of at least one of the plurality of rollers protrudes through the opening enabling frictional contact of the roller surface with the substrate surface. When the dispenser is drawn over the surface, the outer surface of the this roller engages and rolls over the substrate surface. It also coacts with the outer surfaces of the other rollers, causing them to grip the tape and feed it through the opening, enabling the adhesive tape to be applied to the substrate surface.

7 Claims, 8 Drawing Sheets

20
30
31
32
33
34
40
41
42
44
46
48
50
52
54
56
100
110
114
116
120
130
140
150
160

TAPE DISPENSER

BACKGROUND OF THE INVENTION

1. Field of the Invention

This invention relates to a tape dispenser for applying pressure sensitive tape to a substrate surface. The dispenser is provided with a cutter for the tape and a plurality of rollers that smoothly and evenly feed and apply the tape onto the substrate.

2. Description of the Related Art

A roll of adhesive tape typically is mounted in a dispenser. The tape roll is usually a palm sized roll. Such a dispenser includes at least one side wall aligned substantially perpendicular to the axis of the spool. The side wall includes structure for rotatably maintaining the spool in the dispenser. Such a tape dispenser further includes an exposed metal or plastic serrated cutting blade. The cutting blade is mounted to a portion of the dispenser spaced from the spool and is aligned parallel to the rotational axis of the spool. A portion of the tape is may be supported and releasably retained on the cutting blade of the dispenser.

The tape may be used by grabbing a portion of the tape with a thumb and forefinger at a location between the spool and the cutting blade. The tape is then separated from the cutting blade and pulled relative to the dispenser. The pulling force causes the spool to rotate in the tape dispenser, and permit the tape to be dispensed. After a sufficient length of tape has been pulled from the spool, the user then engages a portion of the tape slightly beyond the cutting blade and urges the tape against the cutting blade with sufficient force to sever the tape at a location adjacent the cutting blade. The severed section of tape then is applied to a substrate as needed. Portions of the tape on the spool side of the cutting blade will remain adhered to the cutting blade for the next dispensing operation.

Generally, the user has to visually assess the length of tape required when severing the tape before applying the tape to a surface such as a package or letter. Such visual assessment is rarely accurate and the tape length severed is either too long or too short. Also, in transporting the length of tape to the point-of-use, the tape may twist or crinkle leading to an untidy package closure or letter seal. Finally, it is necessary as a separate step to press the tape firmly into position against the package or envelope. It is thus very difficult through the use of conventional tape dispensers to get the exact length of adhesive tape that you need applied to the exact location you want. Other problems associated with such prior art dispensers are that the end of the tape always remains in an exposed and the exposed cutting blade can be hazardous, particularly to children Still further, such prior art tape dispensers are not well suited for single-handed use. In particular, a small tape dispenser must be gripped by one hand while the other hand engages the tape and pulls the tape from the blade and beyond the dispenser. The one hand remains on the dispenser and the other hand remains on the tape as the tape is severed. The two-handed dispensing of tape can be carried out fairly easily with a small tape dispenser and for a small piece of tape (e.g., 1–2 inches). In particular, the hand that pulls the tape typically will not have to be repositioned to urge the tape against the blade. The dispensing becomes much more difficult if a longer piece of tape is required. In particular, to dispense a long piece of tape, the tape is first grabbed between the blade and the spool and separated from the blade. The user then pulls a sufficient length of tape from the spool and urges the tape against the blade. The hand that has pulled the tape then must be removed from the free end of the tape to engage the tape at a location closer to the blade. This causes the free end of the tape to move, often in response to electrostatic forces. The free end of the tape often will adhere to itself or to an unintended surface.

The above-described complications can be avoided with a large heavy tape dispenser that has a broad base. This type of prior art tape dispenser can be supported without being gripped manually. Hence, the tape can be pulled from the dispenser with one hand, thereby leaving the other hand free for some other purpose, such as holding the object to be taped. Additionally, two hands can be employed, if necessary, to hold both ends of a long piece of tape. However, such a solution still suffers from the usual disadvantages of such dispensers.

Another disadvantage of these prior art dispensers is that the user must manually grip the adhesive surface of the tape at least once to dispense the tape. This manual gripping reduces the adhesiveness of the tape and may transfer soil from the finger to the adhesive side of the tape. The soil, often in the form of a fingerprint, remains on the tape and may be visible on the object to which the tape is applied.

Still further, it is often desirable to apply the tape directly from the dispenser to the object being taped. The large heavy prior art tape dispenser that is suitable for some single-handed use cannot conveniently be positioned adjacent the object to which the tape is to be applied. The lighter weight disposable tape dispenser can be manipulated fairly easily. However, these dispensers are not well suited to direct application of the tape from the dispenser to the object being taped. In particular, the tape can not be fed smoothly onto the surface and pressed into adhesive contact therewith. At best the application is sporadic and two hands are required, i.e., one to hold the dispenser close to the surface and the other to hold the tape onto the substrate to pull the tape from the roll and press it onto the surface.

The following references describe some of the known prior art dispensers:

U.S. Pat. No. 2,823,968 to Marcuse et al. describes a paper towel dispenser having several feed rollers operatively engaged with each other to permit the hand removal of a predetermined length of toweling.

U.S. Pat. No. 3,470,781 to Domeny describes an attachment to a tape dispenser that has a thumb-operated knurled roller on the attachment for engaging and feeding the tape or optionally to permit the tape to be pulled out of the dispenser independently of the roller.

U.S. Pat. No. 3,895,059 to Link describes a tape dispenser that has a guide passage between the chamber in which a roll of tape is retained and the exterior. Oppositely acting ridges in the guide passage exert a holding effect on the tape to keep a free end available to be engaged by the user. A stationary external cutter is pressed against the tape to cutoff a measured length or to cut the tape adjacent where it adheres to the surface to which it is attached. Other forms of the device employ an internal cutter, one of which is manually pressed into cutting engagement with the tape and another of which is snapped into cutting engagement.

U.S. Pat. No. 3,971,280 to Inka describes a tape container and dispensing apparatus formed of plastic material that has a finger operated knurled knob for advancing the tape to dispense a strip of any desired length and a scissors-like shearing means integrally formed therewith a to cut the tape strip.

U.S. Pat. No. 4,640,167 to Stusack et al. describes a single hand operated device for dispensing a desired length of tape from a supply reel. The tape is rotatably supported in a housing and fed out by means of a hand operated drive wheel. The housing also contains a knife which is manually actuable in the direction of the tape to cut the tape.

U.S. Pat. No. 4,775,084 to Morikami et al. describes an adhesive tape case having a cutter that is fixed adjacent to a tape outlet of the case body. In addition, two rollers driven through two gears are provided for advancing a length of tape to the tape outlet. The gears are driven by the manual operation of an operational knob through a rack plate. The rack plate is adapted to engage with one of the gears when moving forward and to separate therefrom when moving backward.

U.S. Pat. No. 5,257,71 to Wirtz-Odenthal describes an apparatus for dispensing an apportioned length of paper towel from a roll and automatically cutting the length from the roll with a knife.

U.S. Pat. No. 6,053,233 to Lin describes an automatic tape cutter/sticker that includes a bottom shell body, a main shell body pivoted to the bottom shell body and turned in and out of aside opening on the bottom shell body, the main shell body having an annular tube, which holds an adhesive tape, and an arched spring plate, which is mounted in the annular tube and having two opposite ends extended out of respective slots on the annular tube to hold the adhesive tape in place, a rotary cutter holder with a cutter blade rotated by the main shell body to cut the free end of the adhesive tape, a rotary guard plate rotated by the main shell body in the reverse of the rotary cutter holder to close/open a tape outlet notch slot on the bottom shell body, and a cover plate covered on the bottom shell body, the cover plate having coupling means at one end hinged to one side of the bottom shell body, and hook means at an opposite side for hooking in a hook hole at an opposite side of the bottom shell body.

U.S. Pat. No. 6,510,884 to Chan describes an adhesive tape dispenser that has a lower compartment with a bottom aperture and a cutting blade at one side of the aperture. A length of tape is dispensed through the aperture and severed by the blade. During dispensing, a pressure roller, mounted adjacent the aperture, is pressed down to press the tape firmly against an external surface and to space the tape away from the cutting blade during dispensing.

U.S. Pat. No. 2002/0069974 to Niermann describes a tape dispenser that includes a tape roll chamber with a hub having an axis about which a roll of tape rotates. A tape dispensing channel that extends from the tape roll chamber is configured to twist the tape approximately 90 degrees about its longitudinal axis. A window is defined near the end of the tape dispensing channel to enable an index finger to apply pressure to the non-adhesive surface of the tape for urging the adhesive surface of the tape against a substrate. A blade support wall is disposed distally of the window and includes a serrated blade for severing the tape. The lower surface of the blade support wall is arcuately configured for urging the tape into secure adhesion with the substrate.

OBJECTS AND SUMMARY OF INVENTION

It is an object of this invention to provide a tape dispenser which permits the application of an adhesive tape to a surface directly from the dispenser using only one hand to accurately position the tape at the proper location on the substrate and precisely cut the correct length of tape to be used.

It is yet another object of this invention to provide a tape dispenser capable of accurately aligning the tape on the surface to which it is to be applied, simultaneously pressing it into adhesive contact with such surface and then accurately cutting off the precisely desired length.

It is still another object of this invention is to provide a tape dispenser wherein the tape is dispensed by the rotation and coaction of the surfaces of a plurality of rollers which are driven by moving the dispenser along the surface to which the tape is to be applied.

Still another object of this invention is to provide a tape dispenser which includes a tape cut-off bar which remains inactive or hidden while the tape is being dispensed and applied but which, by a simple manipulation of the dispenser accurately cuts the tape to the desired length.

An additional object of this invention is to provide a low-cost tape dispenser wherein all parts, both static and moving, are simply constructed and compactly contained.

Also included among the objects of the invention is to provide a tape dispenser wherein the container can be made of inexpensive plastic material.

It is a further object of this invention to provide a tape dispenser that can be used for many type taping operations, such as taping paper together or as packing tape, is easy and intuitive to use and may be used with tape having an adhesive surface on both sides.

It is yet another object of this invention to provide unique a tape dispenser that is similar in appearance to common prior art dispensers but has a unique structure and function.

It is yet a further object of this invention to provide a tape dispenser that is refillable or disposable and may be a desk-top model or portable and may be used solely as a dispenser or as a tape applicator.

It is also an object of this invention to overcome or at least reduce the enumerated problems associated with conventional tape dispensers.

All of the foregoing objects as well as others are achieved by the tape dispenser of this invention. The dispenser is used for applying adhesive tape to a substrate surface, the tape having a first surface with a pressure sensitive adhesive thereon and a second surface. The dispenser includes a housing suitable for holding and dispensing a roll of tape. The housing has an exterior application surface that has a tape dispensing opening therein. A plurality of cylindrical rollers are provided within the housing, each roller having an outer surfaces. The outer surfaces of the rollers coact with each other and the tape surfaces to retain, guide and feed the tape through the tape dispensing opening to the exterior application surface. The outer surface of at least one of the rollers protrudes through the application surface on one side of the opening enabling frictional contact of the roller surface with the substrate surface. Thus, when the application surface of the tape dispenser is drawn over the substrate surface in one direction the outer surface of the roller engages the substrate surface causing the roller to roll along the substrate surface and to coact and drive the outer surfaces other rollers. This causes the rollers to grip the surfaces of the tape and feed the tape through the opening enabling the first surface of the tape with the pressure sensitive adhesive thereon to contact the substrate surface and adhere thereto.

Optionally, the outer surface of another of the rollers protrudes through the application surface on the other side of the opening to contact the second surface of the tape as it is fed through the opening. Thus when the application surface of the tape dispenser is drawn over the substrate surface in the one direction the outer surface of this other roller contacts the second surface of the tape to apply pressure to the tape causing the first surface of the tape with the pressure sensitive adhesive thereon to adhere to the substrate. A cutting blade is mounted to the application surface on the one side of the opening, whereby when the dispenser is moved in a different direction to the one direction, the tape is cut by the blade. The cutting edge of the blade faces the interior of the housing.

BRIEF DESCRIPTION OF THE DRAWINGS

For a more complete understanding of the present invention, reference may be had to the following description of exemplary embodiments of the present invention considered in connection with the accompanying drawings, of which.

DETAILED DESCRIPTION OF THE INVENTION

Figure 1:
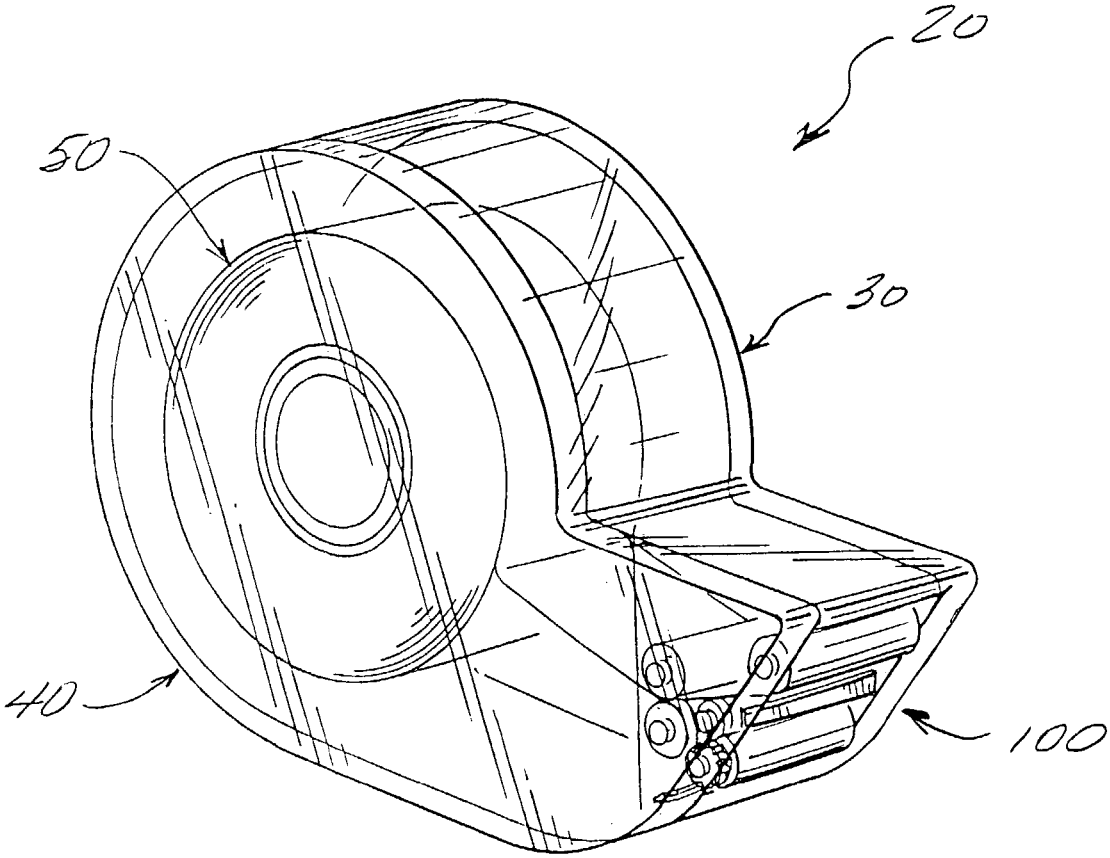
FIG. 1 is a perspective view of one embodiment of the tape dispenser of this invention that uses five rollers to retain, guide and feed the tape through the tape dispensing opening to the exterior application surface.
Figure 2:
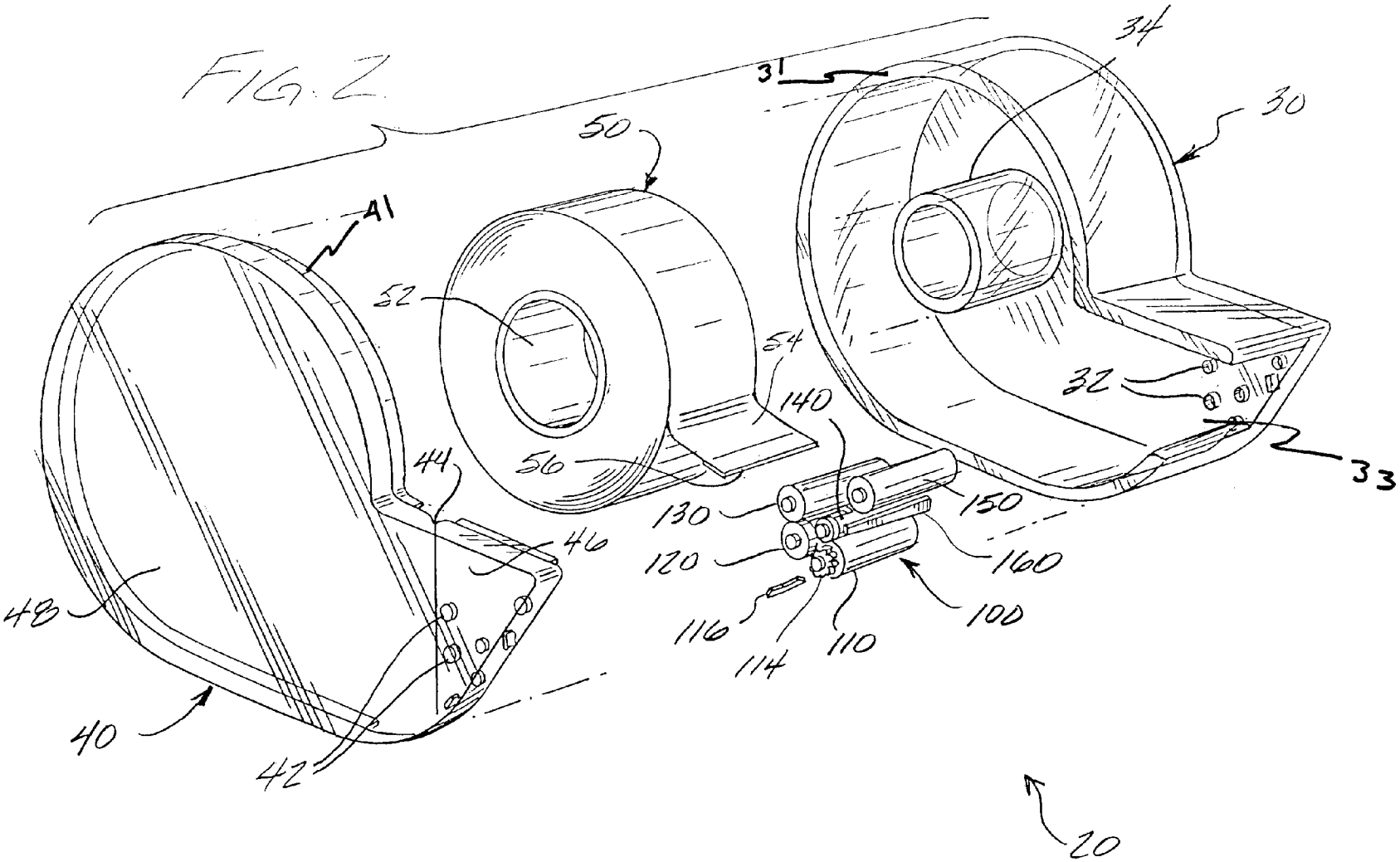
FIG. 2 is an exploded perspective view of the tape dispenser shown in FIG. 1.

Referring to FIGS. 1–5, and in particular FIG. 2, the tape dispenser 20 is comprised of a right housing member 30 and a left housing member 40. Preferably the housing members are made of a plastic material, although any other type material is contemplated, e.g., metal, wood, ceramic. The dispenser 20 can have finger grips (not shown), possibly from rubber, placed at the appropriate places for ease of holding and using the dispenser 20 with the hand H.

The housing members 30, 40 house the roll of tape 50, the roller assembly 100 consisting of a plurality of rollers 110, 120, 130, 140, 150, and the knife blade 160. The roll of tape 50 has a tape core 52 and tape 54 wrapped around the core 52. Preferably the tape 54 has a pressure sensitive adhesive on one surface, although the use of a tape having a double sided adhesive is contemplated.

Referring to FIG. 2, housing member 30 mates with housing member 40 along lips 31 and 41 of the respective housing members 30,40. If it is desired that the tape dispenser 20 be disposable than these members 30, 40 are permanently joined together along their lips 31, 41 to permanently hold the roll of tape 50 and roller assembly 100 therein.

Preferably, as shown in FIGS. 1–5, a rear portion 48 of the housing member 40 is removably joined to housing member 30 to permit the insertion and removal of the roll of tape 50 in operative position in the housing, i.e., with tape core 52 rotatably mounted on spindle 34 attached to the interior of housing member 30. The remaining front portion 46 of housing member 40 is permanently joined to the similar portion of housing member 30 to permanently maintain the roller assembly 100 and knife blade 160 in the housing. As shown more clearly in FIG. 2, housing members 30, 40 are removably mated along a portion of their lips 31, 41, for example, by interlocking lips 31,41. The remaining portion of the lips 31,41, are permanently joined, e.g., glued, together to permanently capture the roller assembly 100 and knife blade 160 between the housing members 30, 40. At a point near the roller assembly 100 a vertical hinge member 44, e.g., a score line of thinner plastic, is included in housing member 40 to permit the rear portion 48 of housing member 40 to be swung away from the rear portion of housing member 30 to permit the removal of the tape roll 50 from spindle 34.

Figure 10:
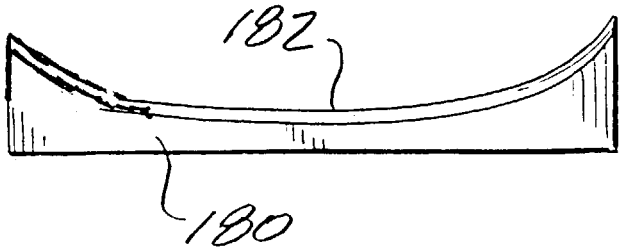
FIG. 10 is a front view of another embodiment of a cutting blade used in the dispenser of this invention.
Figure 11:
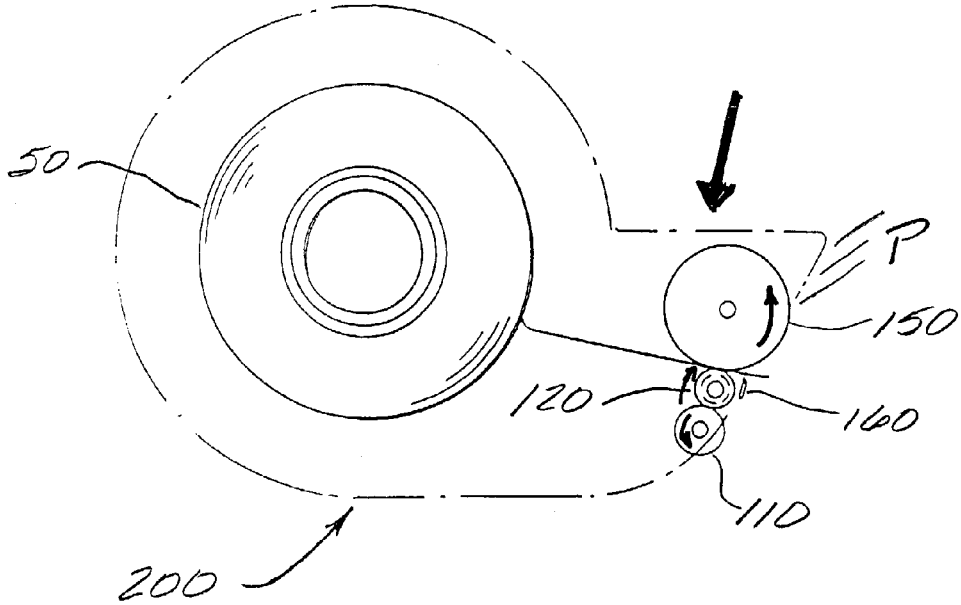
FIG. 11 is a schematic side view of another embodiment of the tape dispenser of this invention that uses three rollers to retain, guide and feed the tape through the tape dispensing opening to the exterior application surface.

Referring to FIGS. 1 and 2 for example, the dispenser 20 has therein an opening 33 therein for dispensing tape 54 therethrough. A drive roller assembly 100 is provided in the dispenser that traverses this opening 33. In the embodiment depicted in FIGS. 1–10 the drive roller assembly comprises five rollers, i.e., a first drive roller 110, a second drive roller 120, a third drive roller 130 a support roller 140 and a pressure roller 150. Although this is the preferred drive roller assembly configuration 100 for optimum tape feed and control, other configurations are contemplated. Referring to FIG. 11, a drive roller assembly comprising three rollers is depicted, i.e., a first drive roller 110, a second drive roller 120, and a pressure roller 150. Additionally, referring to FIG. 12, a drive roller assembly comprising two rollers is depicted, i.e., a drive roller 150 and a guide roller 170.

Referring to FIG. 2, each of the rollers 110, 120, 130, 140, 150 is cylindrical and is adapted to freely rotate about its axis. At each end of each roller 110, 120, 130, 140, 150 is a nub that rotatingly mates within openings 32 in housing 30 and openings 42 in housing 40. Optionally, the nubs are the ends of a rod that passes through each roller and are fixed in the openings 32 and 42 and the rollers rotate about the axis of a fixed rod through their center. When the housings 30 and 40 are affixed to each other they permanently entrap the roller assembly 100. This same structure of entrapping the rollers within the housing may be used in the embodiments depicted in FIGS. 11 and 12.

Referring to FIGS. 1–8, the outer surfaces of each the rollers 110, 120, 130, 140, 150 coact with each other and the tape surfaces 54*a*, 54*b* to retain, guide and feed the tape 54 through the tape dispensing opening 33 to the exterior application surface P, e.g., a package surface. The outer surface of at least one of the rollers, in particular drive roller 110 (see FIG. 4) protrudes through the opening 33 on one side thereof enabling frictional contact of the roller 110 surface with the substrate surface P.

Figure 3:
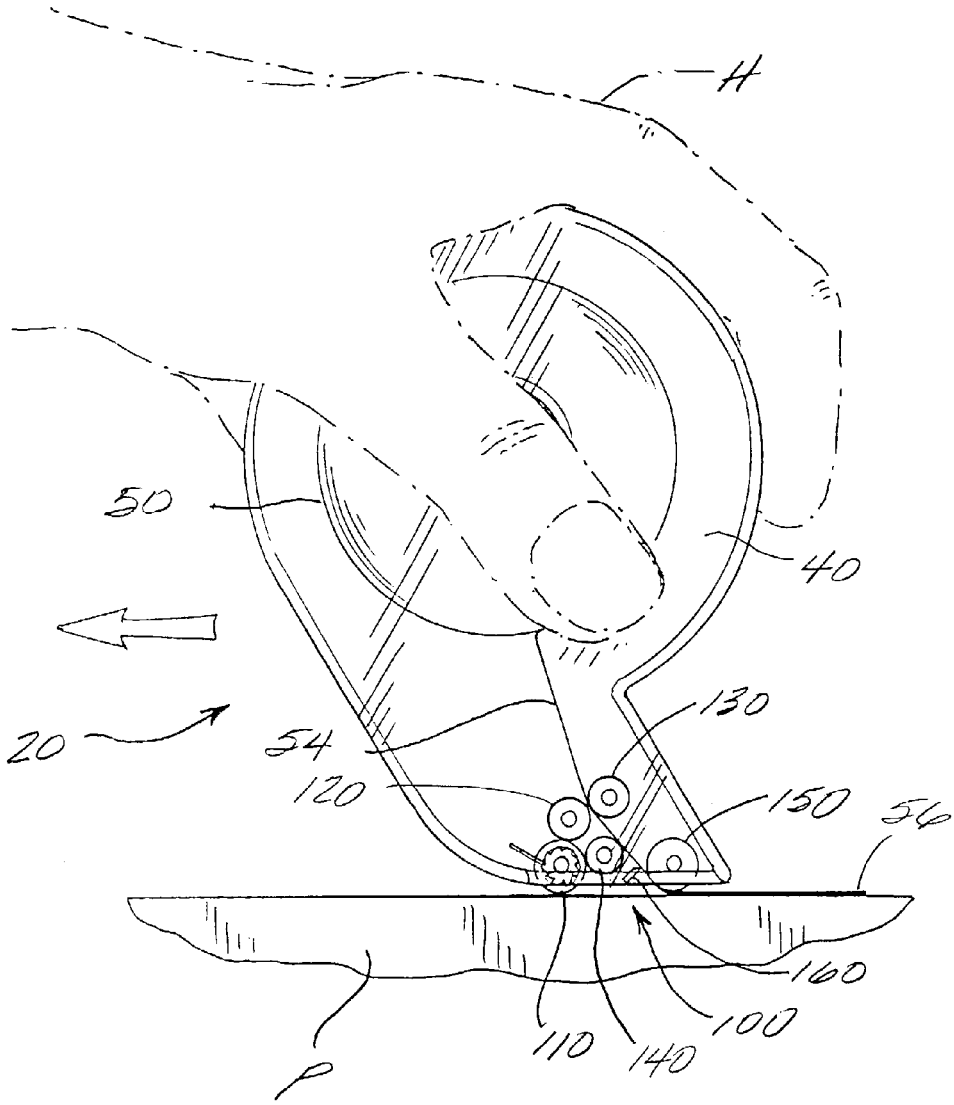
FIG. 3 is a side view of the embodiment of the tape dispenser shown in FIG. 1 being drawn over the substrate surface to which the tape is to be applied.
Figure 4:
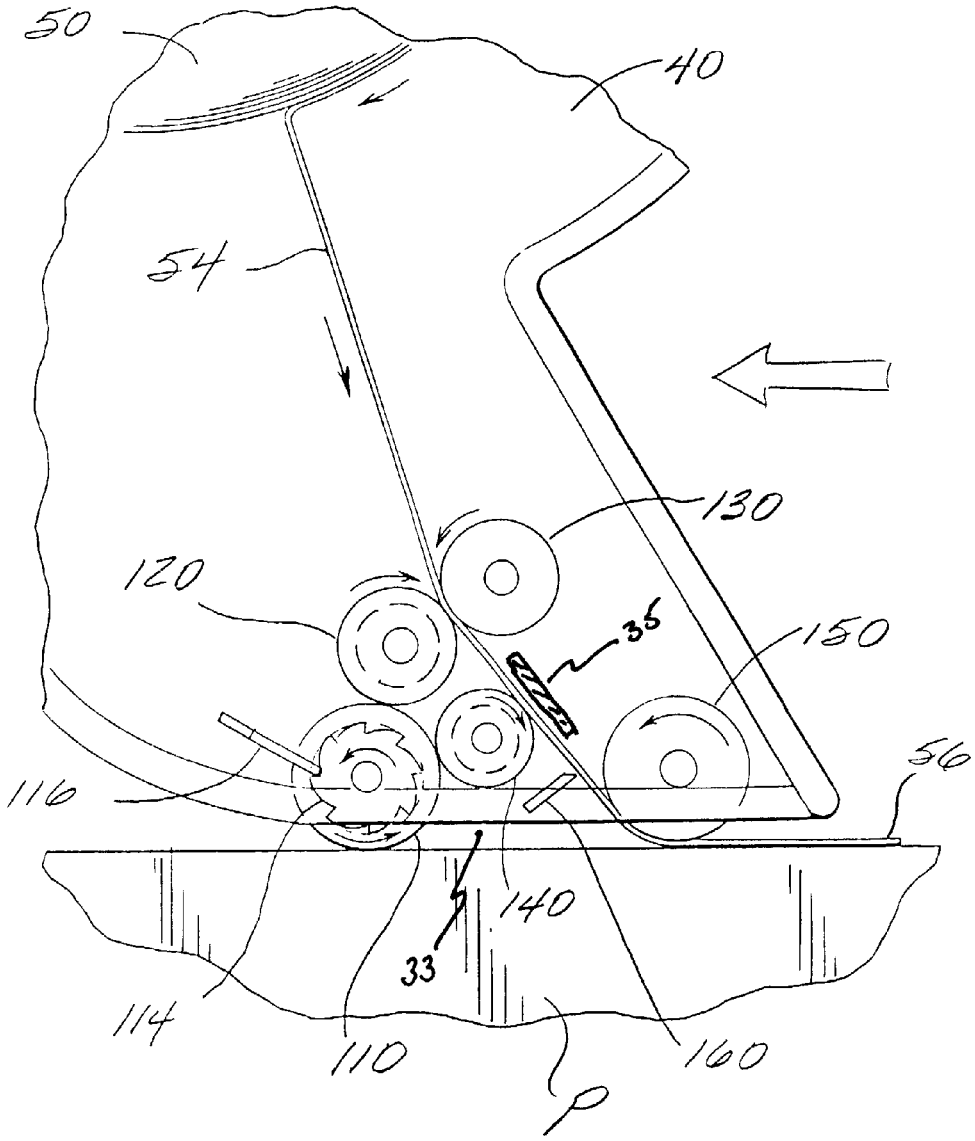
FIG. 4 is a schematic side view of a portion of the embodiment of the tape dispenser shown in FIG. 1 being drawn over the substrate surface to which the tape is to be applied.

Referring to FIGS. 3 and 4, when the tape dispenser 20 is drawn over the substrate surface P in one direction (the arrow to the left) the outer surface of the drive roller 110 engages the substrate surface P causing the roller 110 to roll in a counterclockwise direction along the substrate surface P. Roller 110 then coacts with and drives the outer surfaces of rollers 120 and 140 in a clockwise direction. These rollers 120 and 140 grip the adhesive surface 54*b* of the tape 54 and feed the tape end 56 through the opening 33. Drive or guide roller 130 is in contact with tape surface 54*a* to assist in maintaining the tape surface 54*b* against roller 120 so that it can feed the tape 54. Roller 130 is driven in a counterclockwise direction by the movement of tape surface 54*a* across the surface of the roller.

Optionally, as depicted FIGS. 3 and 4, in the outer surface of roller 150 protrudes through the opening 33 on the other side of the opening to contact the second surface of the tape 54*a* as it is fed through the opening 33. Thus when the tape dispenser 20 is drawn over the substrate surface P in the direction of the arrow (left) the outer surface of this roller 150 contacts the second surface 54*a* of the tape to apply pressure to the tape 54 causing the first surface of the tape 54*b* with the pressure sensitive adhesive thereon to adhere to the substrate P.

Like wise in the three roller configuration shown in FIG. 11, when the tape dispenser is drawn over the substrate surface the outer surface of the drive roller 110 engages the substrate surface causing the roller 110 to roll in a counterclockwise direction. Roller 110 then coacts with and drives the outer surface of roller 120 in a clockwise direction. Roller 120 grips the adhesive surface 54*b* of the tape 54 to feed the tape end 56 through the opening 33. Pressure roller 150 is in contact with tape surface 54*a* to assist in maintaining the tape surface 54*b* against roller 120 so that it can feed the tape 54. Pressure roller 150 is driven in a counterclockwise direction by the movement of tape surface 54*a* across the surface of the roller to press the tape onto the substrate P.

Figure 12:
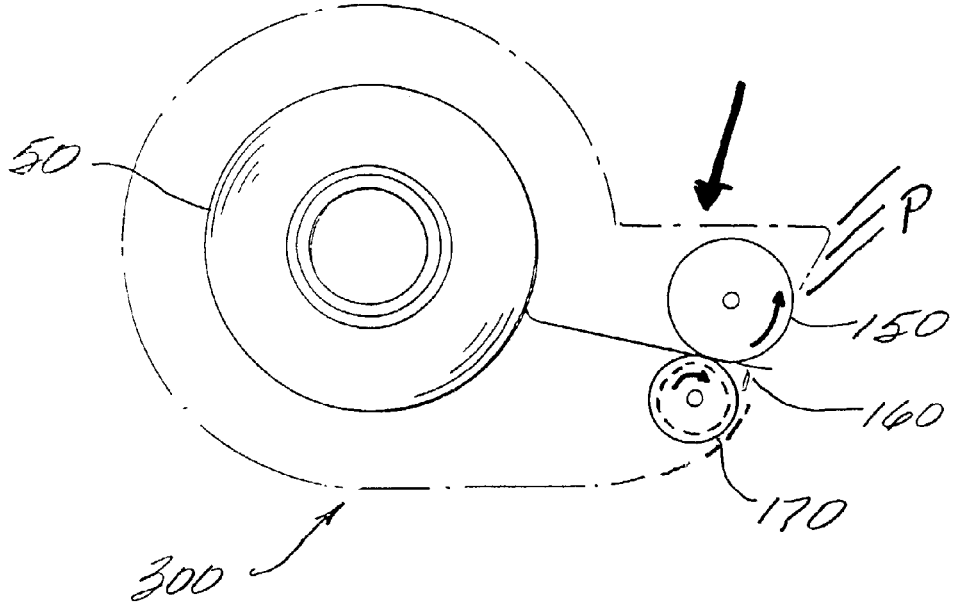
FIG. 12 is a schematic side view of another embodiment of the tape dispenser of this invention that uses two rollers to retain, guide and feed the tape through the tape dispensing opening to the exterior application surface.

Similarly in the two roller configuration shown in FIG. 12, when the tape dispenser is drawn over the substrate surface the outer surface of the drive roller 150 engages the substrate surface causing the roller 150 to roll in a counterclockwise direction. Roller 150 then coacts with the tape surface 54*a* to feed the tape end 56 through the opening 33. Roller 170 is in contact with tape surface 54*b* to assist in maintaining the tape surface 54*a* against roller 150 so that it can feed the tape 54. Roller 170 does not contact substrate P. Roller 150 is then rolled across tape surface 54*a* to press the tape onto the substrate P.

There are advantages and disadvantages to each configuration of rollers. In general, the more rollers there are in the roller assembly, the more flexibility and control the user has of the tape feed and application. The less rollers there are in the roller assembly, the less complex and costly the dispenser.

Referring to FIG. 4, optionally a guide member 35 may used to guide the tape 54 through the rollers. The guide 35 can be molded from the side of one of the housing members 30, 40.

Figure 5:
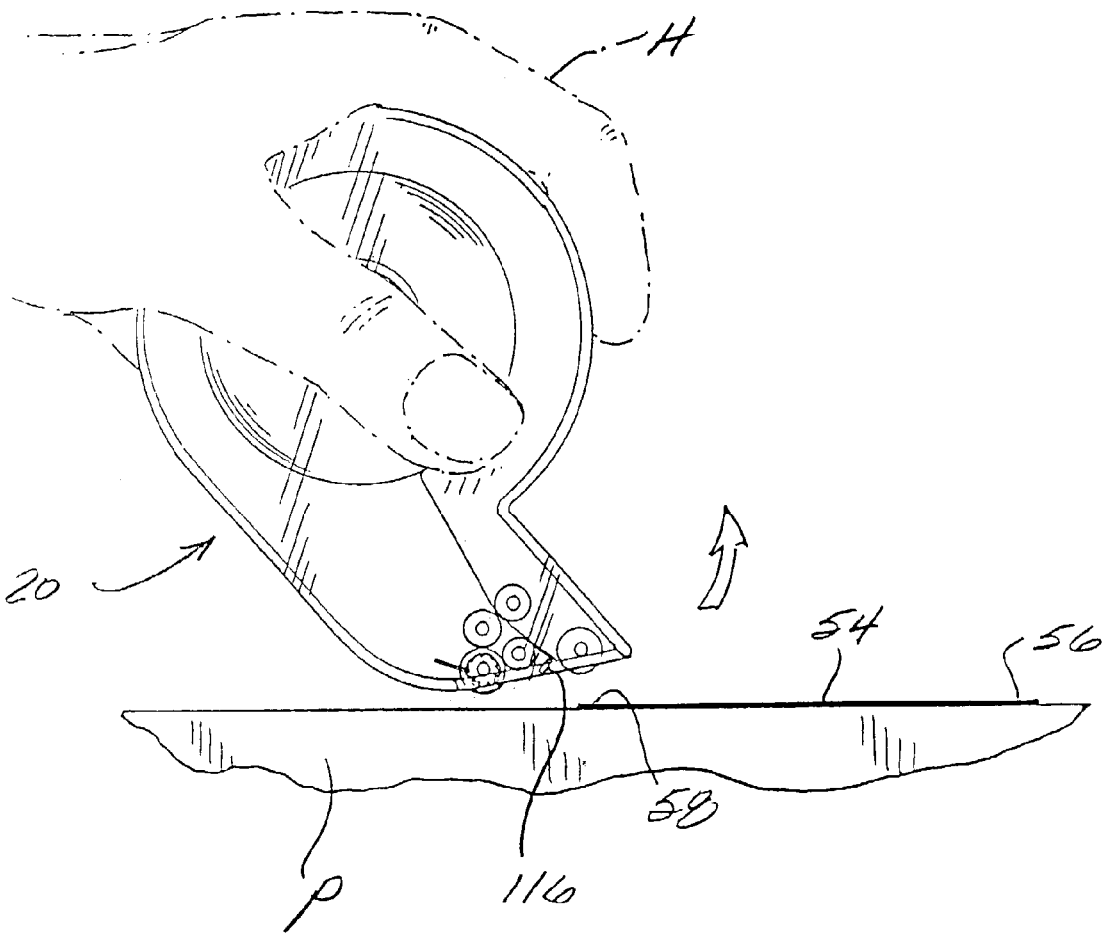
FIG. 5 is a side view of the embodiment of the tape dispenser shown in FIG. 1 after the dispenser has applied the tape to the substrate and has cut the tape.
Figure 9:
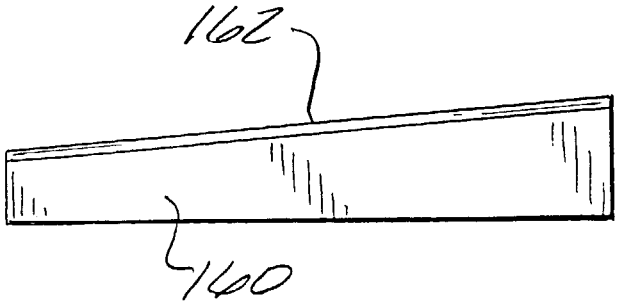
FIG. 9 is a front view of one embodiment of a cutting blade used in the dispenser of this invention.

As best seen in FIG. 4, a cutting blade 160 is mounted across the opening 33 on one side of thereof. As depicted in FIG. 2, each end of the blade is mounted in an opening 32, 42 of the respective housing member 30,40. The angle at which the blade 160 addresses the tape 54 does not seem to be critical. FIGS. 9 and 10 show two embodiments of the blade used to cut the tape 54. FIG. 9 shows a straight blade 160 with cutting edge 162. FIG. 10 shows a curvilinear blade 180 with cutting edge 182. These type blades can easily cut tape 54. The roller assembly 100 should be arranged in such a way that the sharp edge of the blade 162, 182 faces into the dispenser 20 housing making it safe. Such a configuration makes the dispenser very safe to use in that there is minimal chance to cut someone using it. Referring to FIG. 5, after application of the desired length of tape one merely lifts the dispenser 20 (arrow) or moves it slightly in the opposite direction to cut the tape 54 with the knife blade 162.

The rollers can be arranged in a number of ways. They can be positioned in different locations in the device and be of various sizes. The number of rollers used can also vary. These things would be determined partially by the shape of the 'taper' front-end design desired and the cutting blade placement.

The individual rollers are configured to perform the function that they must perform. For example, referring to FIG. 4, it is preferred that roller 110 have a high coefficient of friction between the roller surface and the substrate P so that it can be driven by merely rolling over surface P. Therefore it is preferred that the roller surface be made of a rubber/polymeric type material that grips substrate P. On the other hand, although it is desirable that rollers 150 and 130 also have a rubbery texture, this is not as critical.

Figure 6:
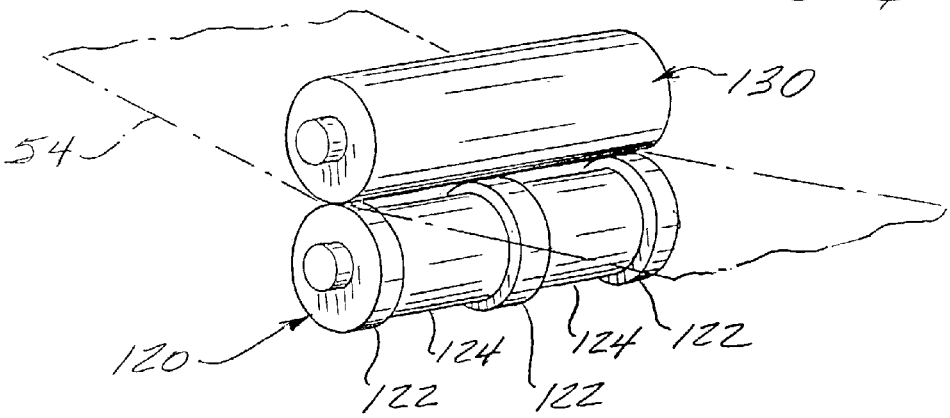
FIG. 6 is a perspective view of one embodiment of two of the rollers in the tape dispenser housing that grip the surfaces of the tape to assist in feeding the tape through the dispenser opening.
Figure 7:
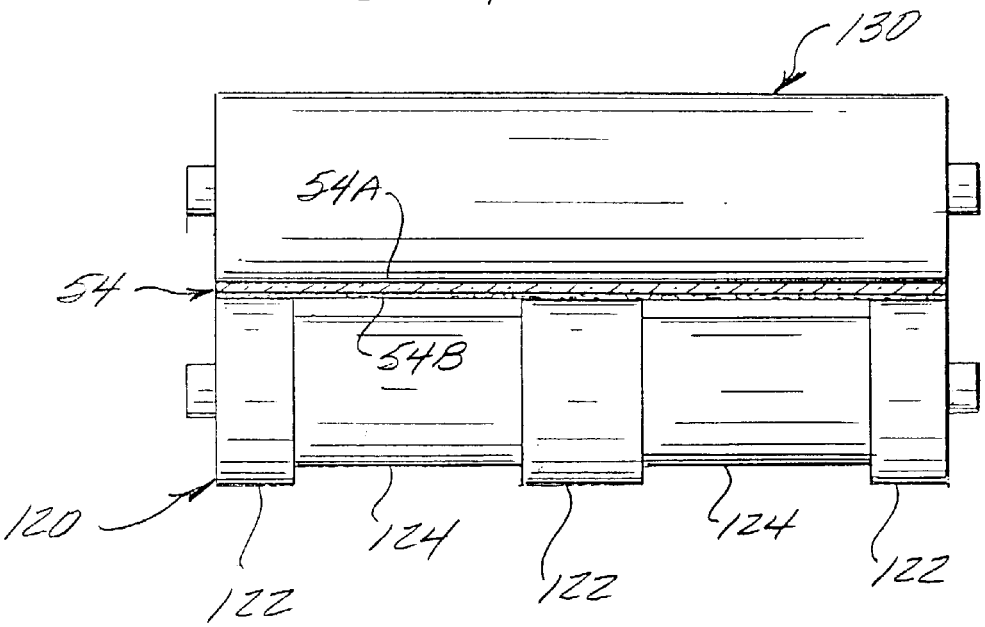
FIG. 7 is a front view of the two rollers shown in FIG. 6 that grip the surfaces of the tape.
Figure 8:
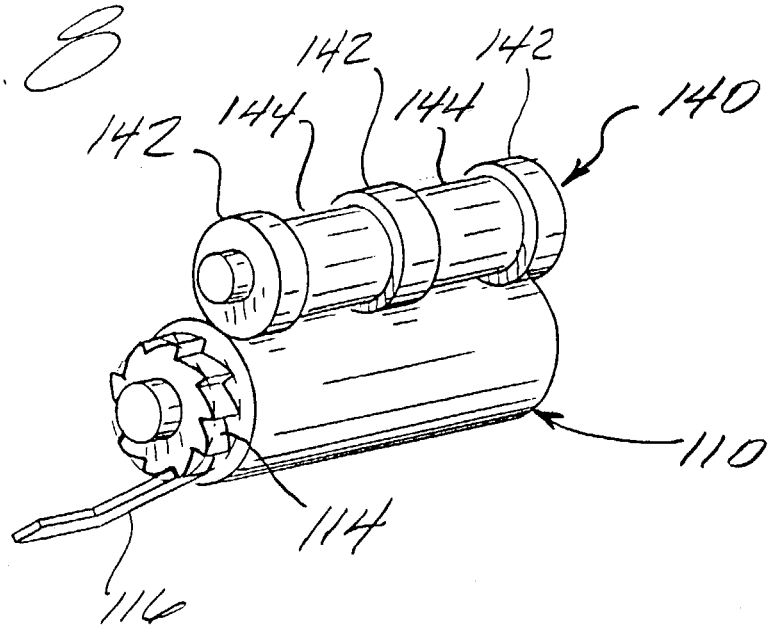
FIG. 8 is a perspective view of another embodiment of two of the rollers in the tape dispenser housing that grip the surfaces of the tape to assist in feeding the tape through the dispenser opening.

Rollers 120 and 140 are of similar design. This design is depicted in FIGS. 6, 7 and 8. These Figures show roller 120 being substantially similar to roller 140. The outer surface of rollers 120 and 140 are in contact with the adhesive side 54*b* of tape 54. Preferably they are shaped to minimize the contact of the roller surface with tape surface 54*b*. Preferably the outer surface is smooth. Additionally, it is shaped to reduce contact of the roller surface with the adhesive side 54*b* of the tape 54. This is done by the use of a reduced diameter 124 over a major portion of the roller surface so that the tape surface 54*b* only rests on ridges 122. This structure prevents the tape surface 54*b* from sticking to the roller as it passes through the roller assembly 100. If a double-sided tape is used, rollers 130 and 150 are preferably be the same structure as rollers 120 and 140.

This invention has many advantages. In particular, it solves the 'dangling tape' problem. This is solved by cutting the tape 54 so that the tape end remains in the dispenser 20 (See FIGS. 4 and 5) and thus cannot be seen or touched. The roller assembly 100 then feeds the tape 54 so that it is fed through opening 33 onto the substrate P as the dispenser moves to the left as depicted in FIGS. 3,4,5.

The dispenser of this invention is also designed to control the tape at all times. Referring to FIGS. 3, and 8, to prevent the tape 54 from moving back into the housing of the dispenser 20, roller assembly 100 has roller 110 on one end of it fitted with a ratchet gear 114 and a ratchet stop 116 that engages the ratchet gear 114 if roller 110 rotates clockwise rather than the desired counterclockwise direction. This ratchet gear 114 and roller 110 can be molded as one piece, reducing manufacturing and assembly cost. The ratchet stop 116 can also be molded as one piece with the housing member 30 or 40.

Optionally, guides may be used for some of the rollers. For example, referring to FIG. 4, a guide can be substituted for roller 140 in guiding the tape 54. These guides can be molded as part of the housing 30, 40., thus reducing the cost of the dispenser.

Preferably, the dispenser has finger grips on the outside (not shown) to promote ease of use.

Referring to FIGS. 3,4 and 5, to apply the tape 54 to a surface P, a hand H grips the dispenser 20 and places it on the surface P so that rollers 110 and 150 are on the surface P. The dispenser 20 is moved along the surface P to be taped (right to left in FIG. 3). Roller 110 moves counter-clockwise causing the tape 54 to be moved down and under roller 150. When the tape has been applied, the dispenser 20 is lifted up, off of the surface P, thereby cutting the tape 54 with the blade 160. The beginning if the tape 56 is now out of the way, inside the dispenser 20 ready for the next use.

It will be understood that various changes in the details, arrangements and configuration of the parts and assemblies which have been described and illustrated may be made by those skilled in the art within the principle and scope of the present invention.

What is claimed is:

1. A tape dispenser for applying tape to a substrate surface, the tape having a first surface with a pressure sensitive adhesive thereon and a second surface, the dispenser comprising:

a housing suitable for holding and dispensing a roll of tape, the housing including an exterior application surface having a tape dispensing opening therein;

a plurality of rotatable cylindrical rollers with outer surfaces rotatably mounted within the housing, wherein the surfaces of the rollers coact with each other and the tape surfaces to retain, guide and feed the tape through the tape dispensing opening to the exterior application surface, wherein at least two of the plurality of rollers are opposed rollers that engage the tape surfaces therebetween;

wherein the outer surface of at least one of the plurality of rollers protrudes through the application surface on one side of the opening enabling frictional contact of the roller surface with the substrate surface;

wherein a cutting blade having a cutting edge is fixedly mounted to the application surface, the cutting edge facing into the housing;

whereby when the application surface of the tape dispenser is drawn over the substrate surface in one direction, the outer surface of the roller frictionally engages the substrate surface causing the roller to roll along the substrate surface and to coact and drive the outer surfaces of the other rollers of the plurality of rollers causing them to grip the surfaces of the tape to thereby feed the tape through the opening enabling the first surface of the tape with the pressure sensitive adhesive thereon to contact the substrate surface and adhere thereto, and when the dispenser is moved in a direction different than the one direction, the tape is cut by the blade and retained in the housing between the two opposed rollers.

2. The tape dispenser of claim 1, wherein the housing comprises a left housing member and a right housing member and a portion of these housing members are removably joined to each other to permit the insertion and removal of the roll of tape from the housing.

3. The tape dispenser of claim 1, wherein the housing comprises a left housing member and a right housing member and a portion of the housing members are removably joined to each other to permit the insertion and removal of the roll of tape from the housing and the remaining portions of the housing members are permanently joined to each other to permanently maintain the plurality of rollers in the housing.

4. The tape dispenser of claim 1, wherein the roller in contact with the first surface with the adhesive thereon has a reduced diameter over a portion of its length that is not in contact with the first surface.

5. The tape dispenser of claim 1, wherein the roller in contact with the first surface with the adhesive thereon has a reduced diameter over a substantial portion of its length that is not in contact with the first surface.

6. A tape dispenser for applying tape to a substrate surface, the tape having a first surface with a pressure sensitive adhesive thereon and a second surface, the dispenser comprising:

a housing suitable for holding and dispensing a roll of tape, the housing including an exterior application surface having a tape dispensing opening therein;

a plurality of rotatable cylindrical rollers with outer surfaces rotatably mounted within the housing, wherein the surfaces of the rollers coact with each other and the tape surfaces to retain, guide and feed the tape through the tape dispensing opening to the exterior application surface, wherein at least two of the plurality of rollers are opposed rollers that engage the tape surfaces therebetween;

wherein the outer surface of at least one of the plurality of rollers protrudes through the application surface on one side of the opening enabling frictional contact of the roller surface with the substrate surface, and the outer surface of another of the rollers protrudes through the application surface on the other side of the opening to contact the second surface of the tape as it is fed through the opening;

wherein a cutting blade having a cutting edge is fixedly mounted to the application surface, the cutting edge facing into the housing;

whereby when the application surface of the tape dispenser is drawn over the substrate surface in one direction, the outer surface of the roller frictionally engages the substrate surface causing the roller to roll along the substrate surface and to coact and drive the outer surfaces of the other rollers of the plurality of rollers causing them to grip the surfaces of the tape to thereby feed the tape through the opening enabling the first surface of the tape with the pressure sensitive adhesive thereon to contact the substrate surface and adhere thereto, the outer surface of the other roller contacting the second surface of the tape to apply pressure to the tape causing the first surface of the tape with the pressure sensitive adhesive thereon to adhere to the substrate, and when the dispenser is moved in a direction different than the one direction, the tape is cut by the blade and retained between the two opposed rollers.

7. A tape dispenser for applying tape to a substrate surface, the tape having a first surface with a pressure sensitive adhesive thereon and a second surface, the dispenser comprising:

a housing suitable for holding and dispensing a roll of tape, the housing including an exterior application surface having a tape dispensing opening therein;

a plurality of rotatable cylindrical rollers with outer surfaces rotatably mounted within the housing, wherein the surfaces of the rollers coact with each other and the tape surfaces to retain, guide and feed the tape through the tape dispensing opening to the exterior application surface, wherein at least two of the plurality of rollers are opposed rollers that engage the tape surfaces therebetween;

wherein the outer surface of at least one of the rollers protrudes through the application surface on one side of the opening initially enabling frictional contact of the roller surface with the substrate surface and then subsequently enabling contact with the second surface of the tape as it is fed through the opening;

wherein a cutting blade having a cutting edge is fixedly mounted to the application surface, the cutting edge facing into the housing;

whereby when the application surface of the tape dispenser is drawn over the substrate surface in one direction, the outer surface of the roller frictionally engages the substrate surface causing the roller to roll along the substrate surface and to coact with at least one other roller to grip the surfaces of the tape to thereby feed the tape through the opening, enabling the first surface of the tape with the pressure sensitive adhesive thereon to contact the substrate surface and adhere thereto, the outer surface of the roller then contacting the second surface of the tape to apply pressure to the tape causing the first surface of the tape with the pressure sensitive adhesive thereon to adhere to the substrate, and when the dispenser is moved in a direction different than the one direction, the tape is cut by the blade and retained between the two opposed rollers.

* * * * *